US006293664B1

(12) United States Patent
DeFosse et al.

(10) Patent No.: US 6,293,664 B1
(45) Date of Patent: Sep. 25, 2001

(54) MULTICOLOR LIQUID INK JET PRINT HEAD

(75) Inventors: Stephen Francis DeFosse; Ganesh Vinayak Phatak, both of Lexington, KY (US); Matthew Carlyle Sauers, West Lafayette, IN (US)

(73) Assignee: Lexmark International, Inc., Lexington, KY (US)

( * ) Notice: Subject to any disclaimer, the term of this patent is extended or adjusted under 35 U.S.C. 154(b) by 1222 days.

(21) Appl. No.: 08/537,060

(22) Filed: Sep. 29, 1995

Related U.S. Application Data

(62) Division of application No. 08/165,691, filed on Dec. 10, 1993, now Pat. No. 5,497,178.

(51) Int. Cl.[7] ..... B41J 2/175
(52) U.S. Cl. ..... 347/87; 347/87
(58) Field of Search ..... 347/43, 87

(56) References Cited

U.S. PATENT DOCUMENTS

| | | | | |
|---|---|---|---|---|
| 5,025,271 | | 6/1991 | Baker et al. | 347/87 |
| 5,502,479 | * | 3/1996 | Ishinaga et al. | 347/87 |

FOREIGN PATENT DOCUMENTS

| | | | |
|---|---|---|---|
| 0 373 302 A1 | 6/1990 | (EP) | B41J/2/175 |
| 0 529 879 A1 | 3/1993 | (EP) | B41J/2/175 |

OTHER PUBLICATIONS

Hewlett–Packard Journal, Aug. 1992, article entitled "Automated Assembly of the HP DeskJet 500C/DeskWriter C Color Print Cartridge" by Lee S. Mason and Mark C. Huth, pp. 77–83.

* cited by examiner

*Primary Examiner*—John Barlow
*Assistant Examiner*—Michael S. Brooke
(74) *Attorney, Agent, or Firm*—John A. Brady

(57) ABSTRACT

A multicolor liquid ink jet print head including a print head body containing liquid ink and having a nozzle assembly and electrical connections to the nozzle assembly. The print head body defines passageways to couple the ink from ink chambers in the print head body to the nozzle assembly. The disclosed print head body contains three ink chambers for inks of three different colors, each of which are connected by a separate pathway in the print head body to a separate section of the nozzle assembly. The ink flow channels of the print head body are designed to assure total isolation of each color of ink from each of the other colors. The print head body includes sidewalls and a bottom, with the bottom of the print head body defining three exit ports communicating with the nozzle assembly. One of the nozzle ports communicates with an opening in the bottom of one of the ink chambers. Each of the other two exit ports communicates with a different crossflow channel in the bottom of the print head body which in turn communicates with an opening in the bottom of a different one of the ink chambers. The crossflow channels are formed in molding the print head body to extend to the exterior of the print head body, and each crossflow channel is sealed with a plug to prevent leakage of ink from the crossflow channel.

2 Claims, 7 Drawing Sheets

MULTICOLOR LIQUID INK JET PRINT HEAD

CONTINUATION APPLICATION

This application is a division of application Ser. No. 08/165,691; filed Dec. 10, 1993, now U.S. Pat. No. 5,497,178.

BACKGROUND OF THE INVENTION

This invention relates generally to ink jet print heads and more particularly concerns multicolor ink jet print heads in which the inks must be fed in isolation from one another to separate nozzles.

In a monochrome ink jet print head, liquid ink is contained in the interior of a print head body, perhaps retained within a foam material. If the print head is arranged for operation so that the nozzle assembly is at the bottom of the print head, for example, an exit port is provided in the bottom of the print head body to allow ink to flow to the nozzle assembly. In the case of a thermal ink jet printer, the nozzle assembly includes a heater chip and nozzle plate which cooperate to form an ink supply area downstream of the exit port and channels running to individual nozzle openings for the emission of ink drops to effect printing.

A multicolor ink jet print head contains a number of separate ink-containing chambers separated from one another by walls in a print head body. For example, a three color print head for cyan, magenta and yellow inks includes three separate ink chambers, each of which would typically include an individual foam element for the ink therein.

It is an objective in multicolor print heads of this type to avoid any intermixing of the different colors of ink. In doing this, the ink flow design must accommodate close proximity of three separate exit ports from the print head body to three different sections or areas of a nozzle assembly. For reasons of nozzle assembly manufacture, it is preferred to have the three nozzle arrays for the three colors of ink closely adjacent one another using a single heater chip.

In one known print head body fabrication technique, the bottom of the print head body is formed by ultrasonicly joining a plastic nose piece onto a plastic body part to form the bottom of the print head body. The various flow channels for the three colors of ink are formed cooperatively between the facing surfaces of the nose piece and the body.

This type of assembly requires precise placement of the nose piece relative to the print head body and also runs the risk of leakage of ink at the ink flow passage-defining walls formed when the nose piece is bonded to the body part.

It is a general objective of the present invention to provide a print head in which the print head body is more readily manufacturable and assures isolation of the different colors of ink.

In carrying out the invention, a print head body is employed which includes side and interior walls and a bottom to define at least two separate ink chambers and at least two exit ports in the bottom of the print head body for supplying ink to a nozzle assembly. Included is at least one crossflow channel in the bottom of the print head body which communicates with one of the exit ports and also with an opening in the bottom of one of the ink chambers.

In one form of the print head body, there are three ink chambers and the bottom of the print head body includes two crossflow channels, each communicating between a separate exit port and a different ink chamber in the print head body.

In the illustrated form of the invention, each cross channel is originally formed to extend to the exterior of the print head body and subsequently sealed with a plug inserted into the end of the crossflow channel.

Advantageously, since the crossflow channels are formed completely separately from one another, and without being defined by a process of mating one surface with another, there is complete isolation of the inks flowing through the crossflow channels.

As will be described in more detail subsequently, the exit ports, chamber openings, and crossflow channels are formed in the bottom portion of a unitary print head body during an injection molding operation.

DETAILED DESCRIPTION

Figure 4:
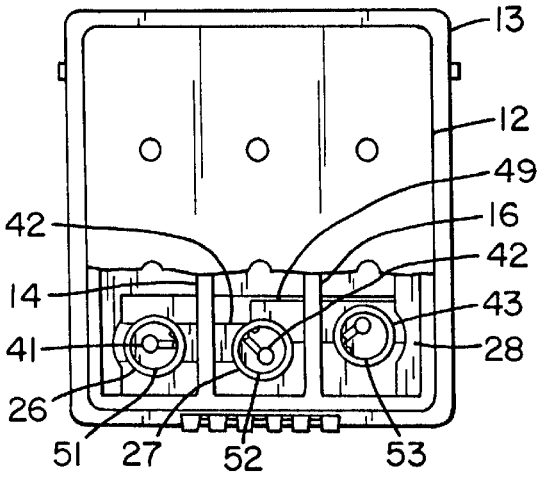
FIG. 4 is a top view of the print head of FIG. 1, with portions removed to permit viewing of the ink flow channels in the bottom of the print head body.
Figure 1:
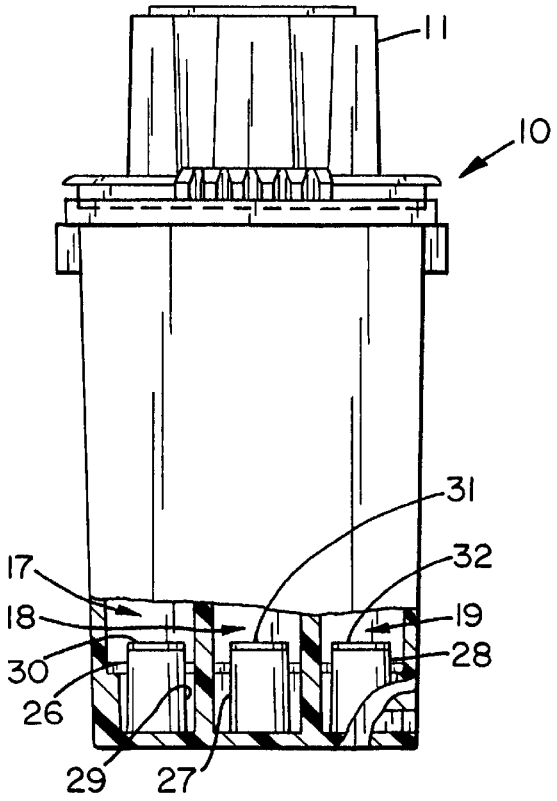
FIG. 1 is a front view, with portions removed, of a multicolor liquid ink jet print head.
Figure 2:
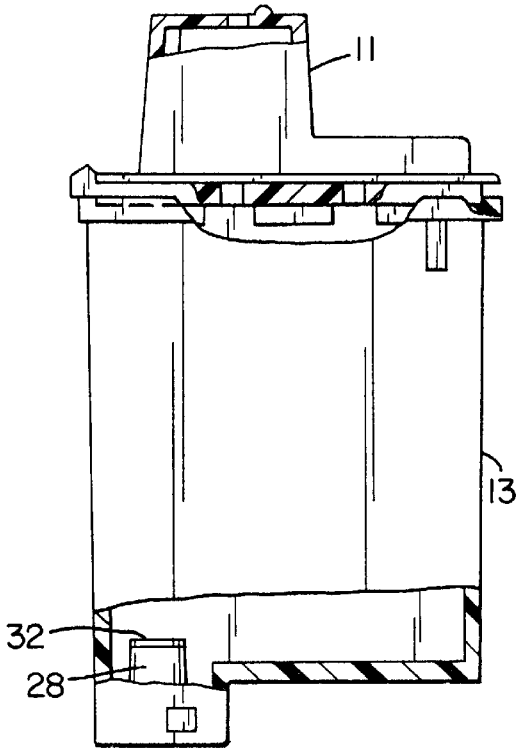
FIG. 2 is a side view of the print head of FIG. 1, with portions removed.
Figure 3:
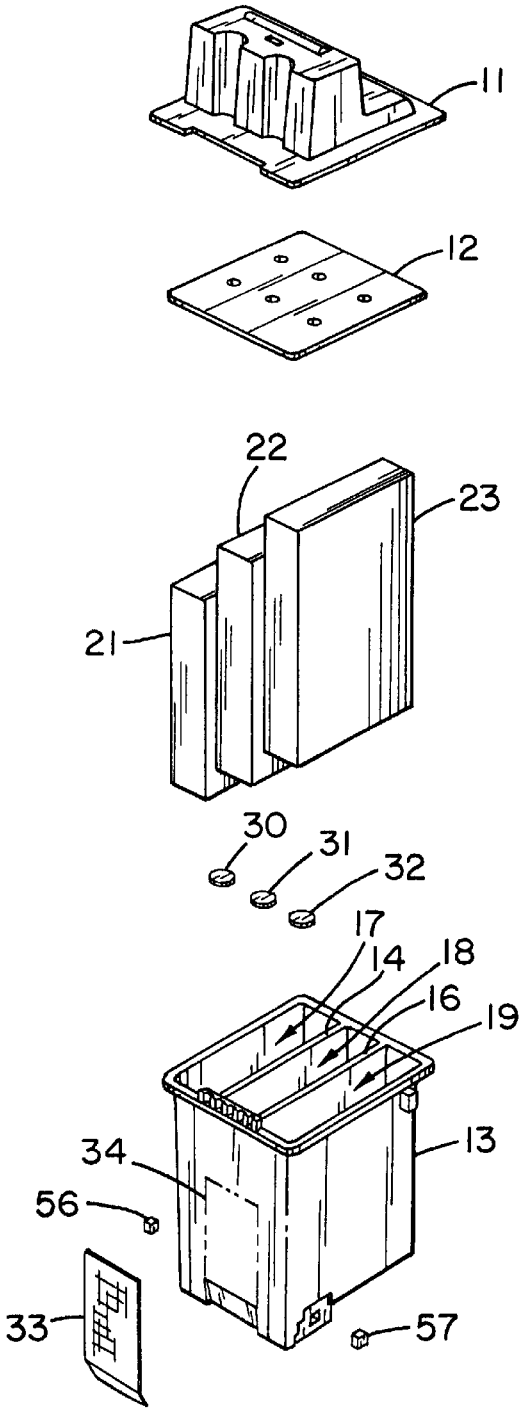
FIG. 3 is an exploded view of the print head of FIG. 1.
Figure 5:
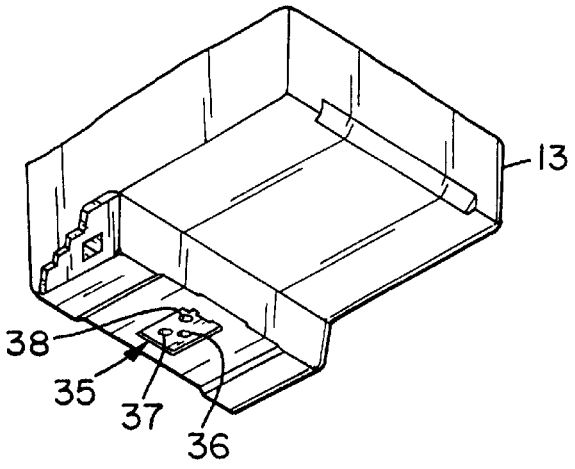
FIG. 5 is a bottom view in perspective of a portion of the print head of FIG. 1.
Figure 6:
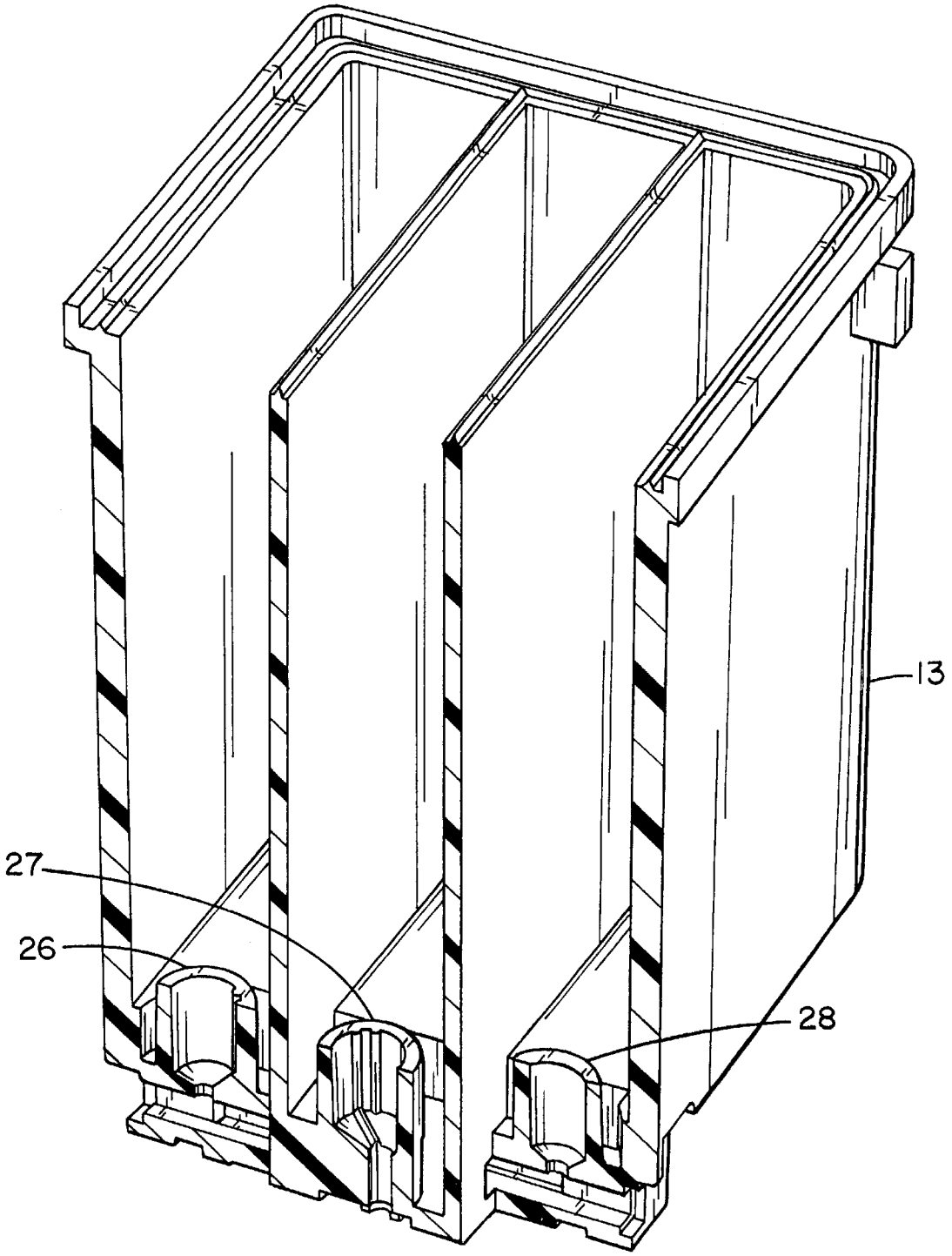
FIG. 6 is a perspective, sectional view of the print head body.
Figure 7:
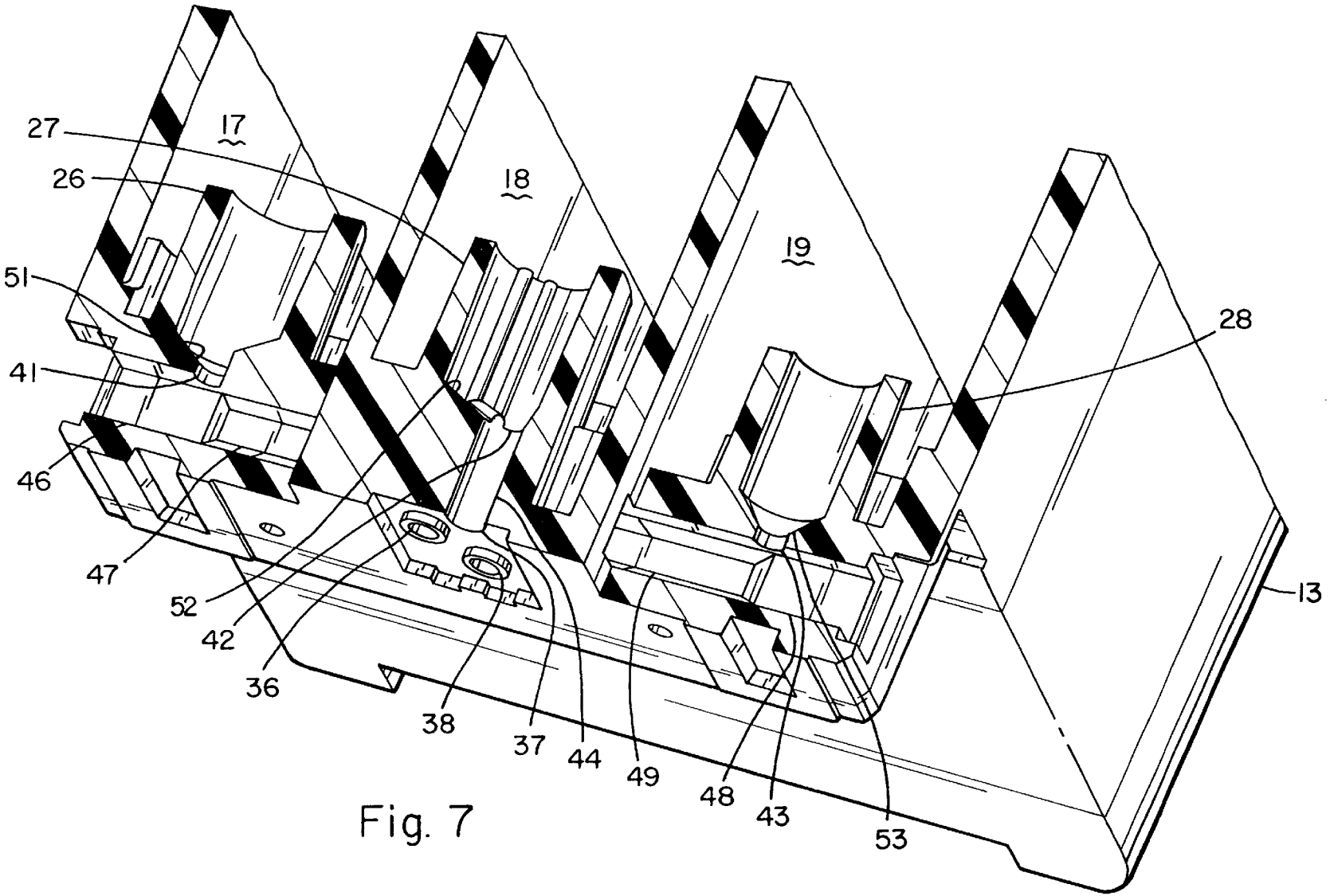
FIG. 7 is an enlarged sectional view in perspective of the lower portion of the print head body, viewed from below.
Figure 8:
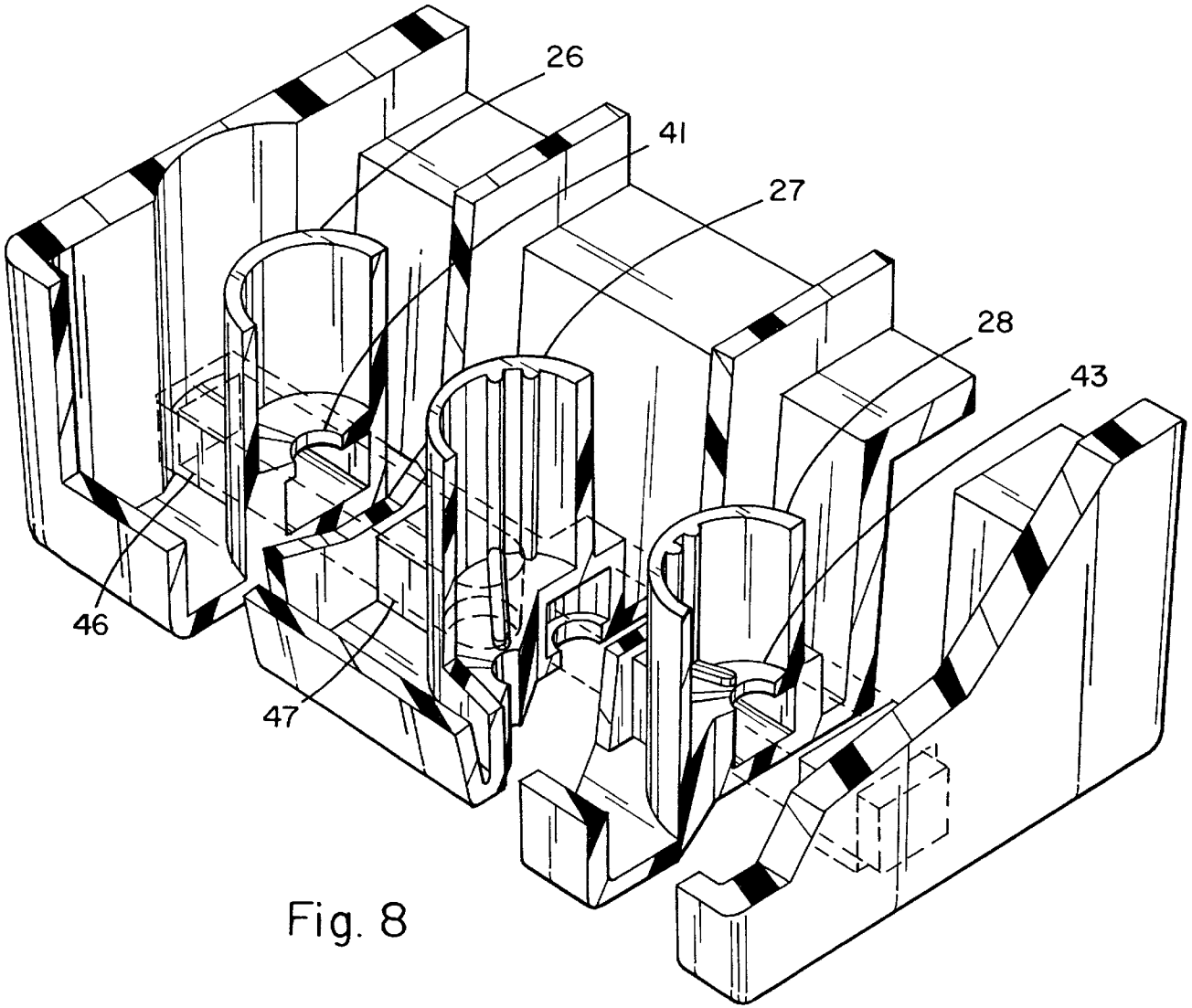
FIG. 8 is an enlarged sectional view in perspective, with portions removed, of the lower portion of the print head body.

With initial reference to FIGS. 1–5, an ink jet print head 10 includes a lid 11 and an upper ventilator 12 received beneath the lid on the top of a print head body 13. These components of the print head are plastic, with the presently preferred material being a modified polyphenylene oxide, Noryl SE-1 of GE Plastics. The material selected must be moisture resistant and chemically compatible with the components of the ink to be held in the print head body.

The print head body 13 includes interior walls 14 and 16, which serve to divide the body 13 into three interior ink chambers 17, 18, and 19. Each ink chamber 17, 18, and 19 contains a foam block 21, 22 or 23, respectively to hold each of the three colors of ink to be carried in the print head body 13. The foam blocks are a reticulated polyether-polyurethane foam, with the presently preferred material being Foamex Corp. SIF Felt No. 03Z70A0532.

Each of the ink chambers 17, 18, and 19 includes in a lower, front portion thereof a chimney, or a stand pipe, 26, 27 or 28, respectively. These stand pipes 26–28 extend slightly above a bottom surface 29 of the ink chambers. Each chimney 26, 27, and 28 has a disk-shaped filter 30, 31 or 32, respectively, secured on its upper end. The filters 30–32 are made up of a dynamesh filter medium rated at 20 microns, available from Fluid Dynamics Corp., Deland, Fla.

A tape automated bonding (TAB) circuit 33 is secured with heat and pressure to a side 34 of the print head body 13 as a means to make electrical connections to a thermal ink jet print head chip (not shown), which is located in the area 35 (FIG. 5) on the bottom of the print head body.

Ink of the three colors contained in the print head body 13 is supplied to the print head chip through three exit ports located entirely under second ink chamber 18 in the bottom of the print head body. These exit ports 36, 37, and 38 communicate with the ink chambers 17, 18, and 19, respectively, as shall be described hereinafter. Each of the stand pipes 26–28 has a main portion tapering slightly (in inside diameter) but substantially cylindrical, with the bottom portions 51–53 of each tapering to a reduced diameter bottom opening 41, 42 or 43, respectively. The opening 42 in the bottom of the stand pipe 27 communicates with the exit port 37 through a channel 44, which extends substantially downwardly from the opening 42. The opening 41 in the bottom of the stand pipe 26 communicates with a wide portion 46 of a crossflow channel 47 which in turn is connected to the exit port 36. The opening 43 in the bottom of the stand pipe 28 communicates with a wide portion 48 of a crossflow channel 49 which is connected to the exit port 38.

The openings 41 and 43 are substantially cylindrical and extend substantially straight downward into the associated crossflow channels. The opening 42, the channel 44, and the exit port 37 comprise a generally cylindrical structure extending downward. As best seen in FIG. 4, the opening 41 in the bottom of the stand pipe 26 is generally centrally located in a tapered portion 51 at the bottom of the stand pipe. The tapered portion 52 at the bottom of the stand pipe 27 angles forwardly to locate the opening 42 toward the front of the print head body 13. The tapered portion 53 of the stand pipe 28 tapers rearwardly to locate the opening 43 toward the rear of the print head body 13.

In this way, the crossflow channel 47 can extend in a straight path behind the channel 44 to terminate at the exit port 36, while the crossflow channel 49 can extend in a straight path behind the line of the crossflow channel 47. Therefore, the various channels do not intersect.

Figure 9:
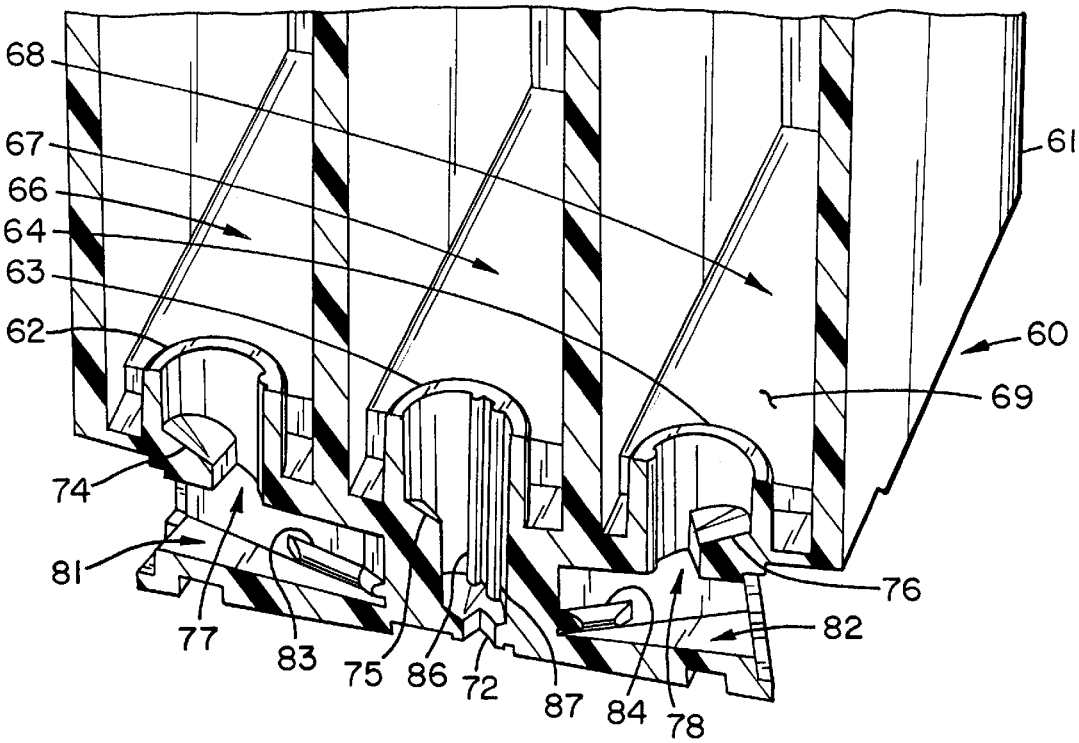
FIG. 9 is a perspective, sectional view of an alternative form of print head body.
Figure 10:
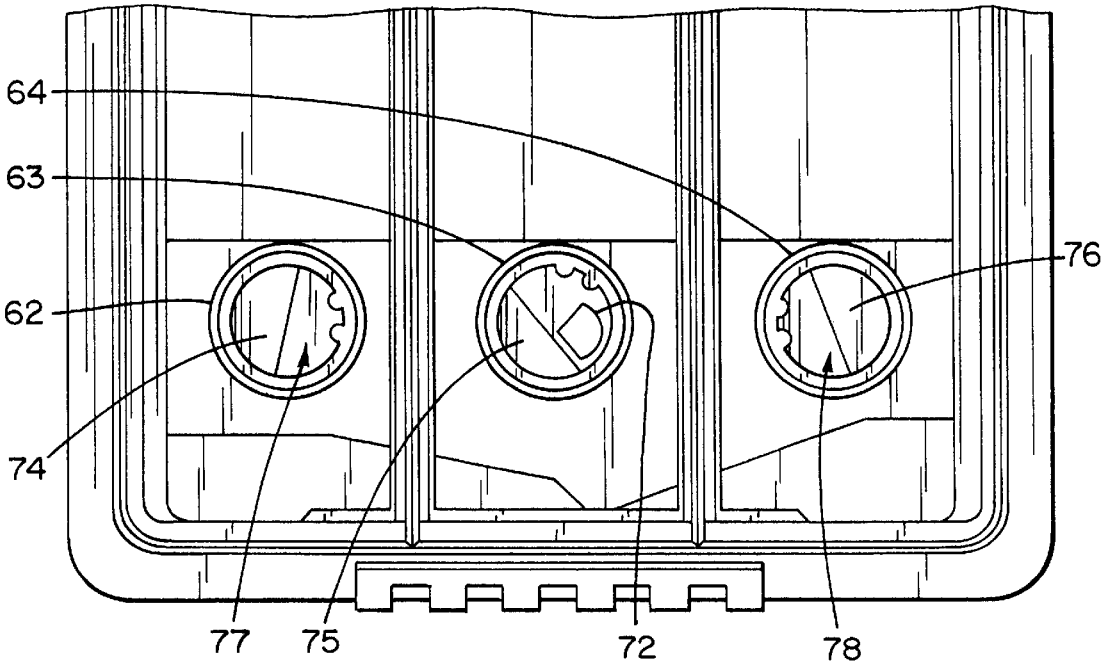
FIG. 10 is a top view of the lower portion of the print head body of FIG. 9.
Figure 11:
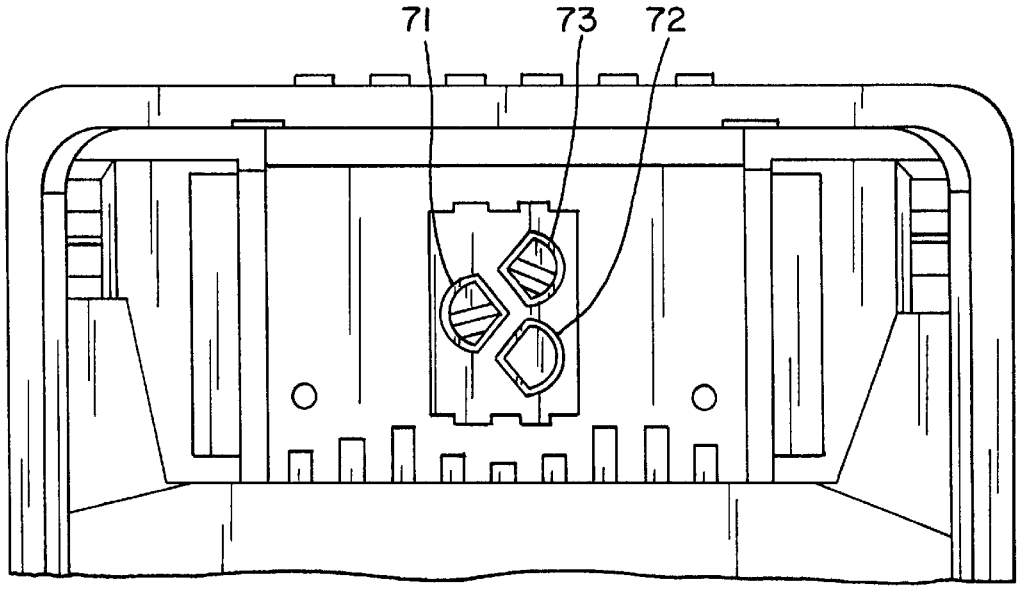
FIG. 11 is a bottom view of the print head body of FIG. 9.
Figure 12:
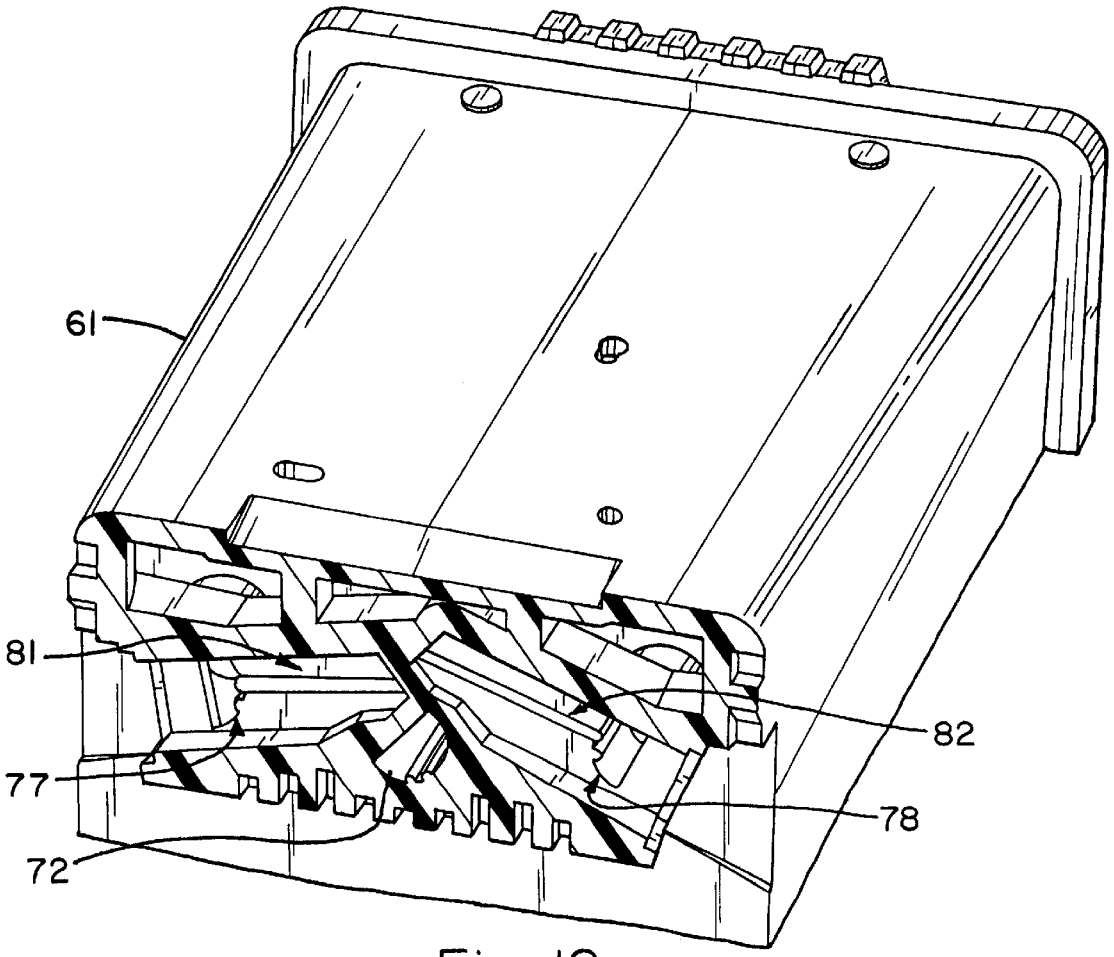
FIG. 12 is a sectional view in perspective of the lower portion of the print head body of FIG. 9 showing the channel structure therein.

Each of the stand pipes such as 27 includes a pair of ribs such as 86, 87 (FIG. 9) extending from the inner wall thereof from the top of the stand pipe to the opening 42. These ribs insure the passage of ink downwardly through the various flow paths to the print head chip despite the presence of bubbles in the flow path.

The print head body 13, with its various ink chambers and flow channels, is conveniently injection molded. The molding techniques are conventional. Generally, the crossflow channels 46, 47 and 48, 49 are formed by retractable side cores, with the mold parting in a direction transverse to the direction of the crossflow channels. The openings 41 and 43 in the bottoms of the stand pipes 26 and 28 are formed by spring loaded pins in the mold.

The crossflow channels 46, 47 and 48, 49 are sealed at the exterior sides of the print head body 13 by plugs 56 and 57 which are inserted to the openings left by the retractable side cores and ultrasonicly welded therein. The plugs 56 and 57 are preferably formed of the same Noryl material as the cartridge body 13. In this way the print head body 13 can be molded in a conventional manner, but the ink flow channels are completely separated from one another to avoid mixing of the different inks.

With reference now to FIGS. 9–12, an alternative, presently preferred, form of print head 60 includes a print head body 61 containing, in its lower portion, three standpipe portions 62, 63 and 64. Print head 60 is substantially the same as the print head 10, except for the standpipe and ink flow structures in the lower portion of the print head body 61.

These standpipes 62, 63 and 64 are located in separate ink chambers 66, 67 and 68, respectively. The standpipes 62–64 extend slightly above a bottom surface 69 of the ink chambers. Ink contained in each of the various chambers 66–68 of the print head body 61 is supplied to the print head chip through three exit ports in the bottom of the print head body. The exit ports 71, 72 and 73 communicate with the ink chambers 66, 67 and 68, respectively.

Each standpipe 62, 63 and 64 contains a generally downwardly sloping lower surface 74, 75 and 76. An opening 77 in the bottom of the standpipe 62 permits ink to flow downwardly into a crossflow channel 81. An opening 78 in the bottom of the standpipe 64 permits ink to flow downwardly into a crossflow channel 82. Ink in the chamber 67 flows downwardly through the standpipe 63 directly to the exit port 72.

The cross channel 81 slopes downwardly and forwardly, terminating in a reduced cross-section portion 83 which in turn leads to the exit port 71. Similarly, the cross channel 82 slopes downwardly and forwardly to terminate in a reduced cross-section portion 84 and the exit port 73. Each of the standpipes such as 63 includes a pair of ribs such as 86 and 87 extending from the inner wall thereof. As in the case of the print head of FIGS. 1–8, the crossflow channels 81 and 82 are sealed at their exterior sides by plugs which are ultrasonicly welded therein.

What is claimed is:

1. An ink jet print head body comprising sidewalls and a bottom defining an interior space within said sidewalls and said bottom, two interior walls dividing the interior space into first, second, and third ink chambers, said second ink chamber being in the center of said print head body, the bottom of said print head body being formed to define first, second and third exit ports generally centrally located in said bottom entirely under said second chamber and spaced from all areas under said first chamber and under said third chamber, the bottom of said print head body being formed to define a first crossflow channel communicating with said first ink exit port and with an opening in the bottom of said first ink chamber and to define a second crossflow channel communicating with said third ink exit port and with an opening in the bottom of said third ink chamber, said second exit port communicating with an opening in the bottom of said second ink chamber.

2. The print head body of claim 1 in which said first and said second crossflow channels slope downwardly.

* * * * *